US010813397B2

(12) United States Patent
Hansen

(10) Patent No.: US 10,813,397 B2
(45) Date of Patent: Oct. 27, 2020

(54) GLOVE AND A METHOD OF MANUFACTURING A GLOVE

(71) Applicant: GLOVAC INTERNATIONAL APS, Aarhus N. (DK)

(72) Inventor: Jan Erik Vest Hansen, Aarhus C (DK)

(73) Assignee: GLOVAC INTERNATIONAL APS, Aarhus N (DK)

( * ) Notice: Subject to any disclaimer, the term of this patent is extended or adjusted under 35 U.S.C. 154(b) by 0 days.

(21) Appl. No.: 16/604,230

(22) PCT Filed: Apr. 11, 2018

(86) PCT No.: PCT/EP2018/059287
§ 371 (c)(1),
(2) Date: Oct. 10, 2019

(87) PCT Pub. No.: WO2018/189240
PCT Pub. Date: Oct. 18, 2018

(65) Prior Publication Data

US 2020/0113259 A1 Apr. 16, 2020

(30) Foreign Application Priority Data

Apr. 12, 2017 (EP) ..... 17166288

(51) Int. Cl.
*A41D 19/00* (2006.01)
*A41H 33/00* (2006.01)

(52) U.S. Cl.
CPC ..... *A41D 19/0044* (2013.01); *A41H 33/00* (2013.01)

(58) Field of Classification Search
CPC ..... A41D 19/0089; A41D 19/0044; A41D 19/0058; A41D 19/0079; A41D 19/01588; A41H 33/00
See application file for complete search history.

(56) References Cited

U.S. PATENT DOCUMENTS 2,299,855 A 10/1942 Smith
2,641,767 A 6/1953 La Rosa
(Continued)

FOREIGN PATENT DOCUMENTS

CN 201451497 U 5/2010
CN 102247023 A 11/2011
(Continued)

OTHER PUBLICATIONS

European Search Report from EP Application No. EP17166288, dated Oct. 13, 2017.
(Continued)

*Primary Examiner* — Sally Haden
(74) *Attorney, Agent, or Firm* — Workman Nydegger

(57) ABSTRACT

A ring-shaped member is arranged for engaging with an opening of a glove to form a circumferential trough around the opening of the glove. A glove and a method of manufacturing a glove comprise a conical collar forming a circumferential trough around the opening of the glove and where the collar comprises such ring-shaped member. The ring-shaped member comprises a first annular portion of a conical shape, a second annular portion of a conical shape, and a central annular portion in between the first and the second annular portions. The ring-shaped member is foldable about the central portion to attain a folded configuration wherein the second annular portion is folded down to lie essentially alongside the first annular portion.

15 Claims, 6 Drawing Sheets

(56) References Cited

U.S. PATENT DOCUMENTS

| | | | | |
|---|---|---|---|---|
| 9,125,443 | B2 * | 9/2015 | Ochi | A41D 19/0062 |
| 2006/0195965 | A1 * | 9/2006 | Knuth | A41D 19/0044 2/159 |
| 2008/0092261 | A1 * | 4/2008 | Yu | A41D 19/0089 2/16 |
| 2011/0277214 | A1 | 11/2011 | Ochi et al. | |

FOREIGN PATENT DOCUMENTS

| | | | |
|---|---|---|---|
| CN | 104939383 | A | 9/2015 |
| EP | 2903484 | A1 | 8/2015 |
| JP | S4314500 | Y1 | 6/1968 |
| JP | S43014500 | Y1 | 6/1968 |
| WO | 9418900 | A1 | 9/1994 |
| WO | 2014056640 | A1 | 4/2014 |

OTHER PUBLICATIONS

International Search Report and Written Opinion from PCT Application No. PCT/EP2018/059287, dated May 31, 2018.
Office Action from corresponding CN Application No. 2018800388456, dated Apr. 29, 2020.

* cited by examiner

GLOVE AND A METHOD OF MANUFACTURING A GLOVE

FIELD OF THE INVENTION

The present invention relates to a glove comprising a collar and to a method for manufacturing such glove.

BACKGROUND

In many types of work situations gloves are required or desired in order to reduce or remove the time the bare hands are in contact or in risk of contact with for instance chemicals, detergents, or bacteria. On the other hand, the risk of skin diseases, allergy, or skin irritations increases if the gloves are used for too long especially if the gloves are of poor quality.

Some gloves are equipped with means for preventing fluids to run down the arms of the user when working. This feature is of particular importance in some working environments like for example for high voltage gloves where the insulating gloves need to protect the worker and any fluid dripping or running from the glove therefore must be prevented or at least guided safely away from the user.

It is known to make gloves (e.g. in U.S. Pat. No. 2,641,767) comprising a reinforcement placed around the glove opening and made of a sponge-like material capable of absorbing some fluid. In EP 2903484 the gloves are made with a folded down border or collar which acts to catch any fluid running down the glove and cause it to run off away from the arm of the user. However, such gloves have shown disadvantageous in the number of separate parts needed and in their manufacturing method. A further problem has been to obtain a reinforced collar of a sufficiently high stiffness to yield the desired effect of a folded down border yet not so stiff or heavy as to get in the way or irritate the user unnecessarily during use.

DESCRIPTION OF THE INVENTION

It is therefore an object of embodiments of the present invention to overcome or at least reduce some or all of the above described disadvantages of the known gloves with a folded down border or cuff by providing a glove with a folded cuff acting to collect fluid and of increased stiffness to keep the shape yet of low weight.

It is a yet further object of embodiments of the invention to provide an effective and more simple manufacturing method for the manufacture of a glove with a folded cuff and at reduced cost.

In accordance with the invention this is obtained by a ring-shaped member for engaging with an opening of a glove to form a circumferential trough around the opening of the glove, wherein the ring-shaped member comprises a first annular portion of a conical shape, a second annular portion of a conical shape, and a central annular portion in between the first and the second annular portions, and wherein a diameter of the ring-shaped member is the smallest at the central portion, and wherein the ring-shaped member is foldable about the central portion to attain a folded configuration wherein the second annular portion is folded down to lie essentially alongside the first annular portion.

A glove comprising a collar positioned around the opening of the glove to form a circumferential trough around the opening of the glove is known in the art and is advantageous in providing the glove opening with a reinforcement of a desired shape. The collar is advantageous for example in providing a seating for the glove when used in devices for taking on and off gloves by the use of a pressure difference to controllably enlarge the glove. For such devices to be effective, the glove—when inserted in the device—needs to engage with a rim or edge of the device to form a closed airtight compartment. Such device is for example disclosed in EP 2903484. The collar may further prevent the glove from being pushed completely into the container when inserted into the device by the user. Further, the collar of the glove forming a circumferential trough in general advantageously functions as a drip or fluid-catcher or a gutter when a user raises his gloved hand for example during cleaning. Hereby any liquid running down the glove is stopped by the collar or is given a different direction and prevented from running down the arm of the user. However, the known gloves have shown disadvantageous in the number of separate parts needed and in their manufacturing method. A further problem has been to obtain a reinforced collar of a sufficiently high stiffness to yield the desired effect of a folded down border yet not so stiff or heavy as to get in the way or irritate the user unnecessarily during use.

By the provision of the ring-shaped member according to the invention is obtained a reinforcement for a glove which in its folded configuration has a high stiffness and stability yet still some flexibility, and at the same time a structure of low weight. The higher stiffness of the ring-shaped member according to the invention when compared to a conventional structure of e.g. two otherwise separate rings clipped together, is believed to be realized because of the bi-stable structure where the second annular portion is folded down onto the first annular portion in the folded configuration. Hereby, the ring-shaped member can be manufactured at smaller wall thicknesses and thereby at a lower weight. This is advantageous in making the ring-shaped usable on gloves of a thinner glove material and thereby usable on gloves for more applications where thinner gloves are preferred. At the same time, the ring-shaped member still comprises some flexibility especially in its transverse direction where the member can be temporarily deformed into a more oval shape. This is advantageous when positioned on a glove in not being in the way for the user and in reducing the risk of getting caught on edges or the like when the user is working.

An important advantage of the ring-shaped member is that the ring-shaped member because of its foldability can be attached to a glove in a very few, simple and fast operations which may optionally be completely automated or optionally completely manual if preferred. The ring-shaped member may be attached to the glove by simply pulling and/or stretching the glove edge over the edge of the second annular portion and then folding the member into its folded configuration. The manufacture of the glove comprising a collar can hereby be performed faster and at lower costs. The manufacturing costs are further reduced by the reduction of the number of component during the assembly of the glove.

Additionally, as the ring-shaped member can be manufactured as a single component in one piece and in a single processing step without the need for any post-processing, the manufacturing costs of the ring-shaped member are likewise reduced.

In an embodiment the first and second annular portions extend essentially the same length from their largest to their smallest diameter. Alternatively, the second annular portion may extend a length larger than the first annular portion. Hereby the second annular portion may cover the first annular portion entirely in the folded configuration. The first and/or second annular portion may extend a length of 5-25 mm such as in the range of 5-10 mm. The conical height of the first and/or second annular portions may be in the range of 5-40 mm, such as in the range of 5-10 mm. The diameter of the central portion may be adjusted to fit different sizes of gloves and may be in the range of 70-150 mm such as in the range of 100-120 mm.

In an embodiment, the central portion of the ring-shaped member comprises a number of holes. Hereby the stiffness of the central portion is reduced and less force is needed to fold the ring-shaped member into its folded configuration while the overall stiffness of the ring-shaped member in its folded configuration is not or only minimally reduced. The holes may advantageously be formed during an injection molding of the ring-shaped member or may be cut in a later step. The central portion may comprise a number of holes depending on the size of the ring-shaped member in the range of 50-200 such as in the range of 60-80. The holes may attain different shapes such as circular, oval or square.

In an embodiment a wall thickness of the central portion is smaller than a wall thickness of the first and/or second annular portion. Hereby the stiffness of the central portion is reduced and less force is needed to fold the ring-shaped member into its folded configuration while the overall stiffness of the ring-shaped member in its folded configuration is not or only minimally reduced. The wall thickness of the central portion may be in the range of 0.5-4 mm, such as in the range of 0.05-1.0 mm, such as in the range of 0.10-0.50 mm, such as in the range of 0.12-0.37 mm. The wall thickness of the central annular portion may be thinner near the center and/or may thicken out towards the first and second annular portions. The height or length of the central annular portion may be in the range of 3-15 mm, such as in the range of 8-10 mm and of approximately 9 mm, or such as in the range of 5-7 mm and of approximately 6 mm. The central annular portion may hereby be dimensioned to correspond to and to fit onto gloves of different material thickness and/or with rolled edges of different sizes.

The wall thickness of the first and second annular portions may be in the range of 0.7-2.0 mm, such as in the range of 0.9-1.2 mm. The first and second annular portions may have the same wall thickness, or may be of different wall thickness, preferably with the second annular portion having a larger wall thickness than the first annular portion. In an embodiment, the ring-shaped member further comprises a number of clips compliantly attached to an edge of the first annular portion. By compliantly attached is to be understood that the clips can be bend at least once or a few times without breaking off the first annular portion. Hereby the clips can be bent about and clipped onto and around the second annular portion when folded, to thereby fixate the ring-shaped member in its folded configuration by simple means and in a simple and fast operation. Hereby the stiffness and thereby the weight of the ring-shaped member can be reduced even further, as the clips aid in holding the ring-shaped member in its folded configuration.

Because the clips are compliantly mounted on the first annular portion, the ring-shaped member can still be manufactured as a single unit in one piece. Further, the attachment to the first annular portion ensured a correct placement of the clips on the ring-shaped member.

In an embodiment, the ring-shaped member comprises a number of clips such as 2, 3, 4, or 5 clips. Advantageously, the clips may be evenly distributed around the circumference of the first annular portion.

The ring-shaped member may be made of a plastic material of the group of PPC, PP, PVC, POM, PP-H, or PE. Hereby the ring-shaped member may be effectively manufactured by injection molding and with a low weight yet high stiffness.

The invention further relates to a glove comprising at a first end a hand-shaped portion and at the opposite second end a shaft portion with an opening for the insertion of a hand of a user, wherein the glove comprises a collar of a generally conical shape and positioned around the opening of the glove, the collar extending from the opening with an increasing diameter in a direction towards the first end of the glove such as to form a circumferential trough on the glove, wherein the collar of the glove comprises a ring-shaped member according to any of the preceding and wherein the ring-shaped member is folded into its folded configuration when positioned on the glove.

The advantages hereof are as mentioned in the previous in relation the ring-shaped member.

In an embodiment, at least the shaft portion of the glove is made of an elastic material and the ring-shaped member is attached to the glove by a portion of the elastic material being stretched over at least the second annular portion of the ring-shaped member. Hereby the ring-shaped member is attached to the glove by few and simple operations yet in an effective manner where the ring shaped member can not fall or be pulled off the glove unintentionally. Further, the attachment can be performed either completely automated or completely manually as desired. Further, the attachment can be performed without the need for any attachment means, neither mechanical nor chemical.

In an embodiment, a portion of the elastic material lies in between the first and the second annular portions when folded. In this way, the ring-shaped member is folded around a layer of the elastic material of the glove thereby holding the layer firmly in place. The ring-shaped member is hereby firmly attached to the glove.

In an embodiment, the glove further comprising a number of clips clipped around at least a part of the ring-shaped member for securing the folded configuration of the ring-shaped member. The clips may be separate members or may be attached to the first annular portion of the ring-shaped member as described in the previous. The clips hereby provide for an additional mechanical fastening of the ring-shaped member to the glove and ensure that the ring-shaped member stays in its folded configuration and cannot open up. Hereby the stiffness and thereby the weight of the ring-shaped member may be reduced even further without jeopardizing the attachment to the glove.

The invention further relates to a method of manufacturing a glove according to any of the preceding, wherein the method comprises the steps of providing a glove of an elastic material, providing a ring-shaped member as described in the above, folding a portion of the glove near the opening over the second annular portion, and folding the ring-shaped member into its folded configuration to thereby form the circumferential trough on the glove. The portion of the glove may be folded by stretching the elastic material of the glove over the second annular portion.

The advantages hereof are as described in relation to the glove and to the ring-shaped member.

In an embodiment, the method further comprises guiding the glove through the central opening of the ring-shaped member. Hereby the glove is conveniently brought into position for stretching the rim of the glove over the second annular member so that the ring-shaped member is attached with the desired orientation on the glove to form the circumferential trough.

In an embodiment the method further comprises clipping one or more clips around at least a part of the ring-shaped member for securing the folded configuration of the ring-shaped member. The advantages hereof are described in the previous.

Alternatively or additionally the method may comprise securing the folded configuration of the ring-shaped member by the addition of an adhesive.

In an embodiment, the method further comprises the steps of providing a fixture and positioning the ring shaped member on the fixture prior to the step of folding the portion of the glove about the second annular portion. The fixture hereby aids in holding the ring-shaped member in position while stretching the glove over the second annular portion. The method can in this way be performed at higher speed and more easily.

BRIEF DESCRIPTION OF THE DRAWINGS

In the following different embodiments of the invention will be described with reference to the drawings, wherein.

DETAILED DESCRIPTION OF THE DRAWINGS

Figure 1:
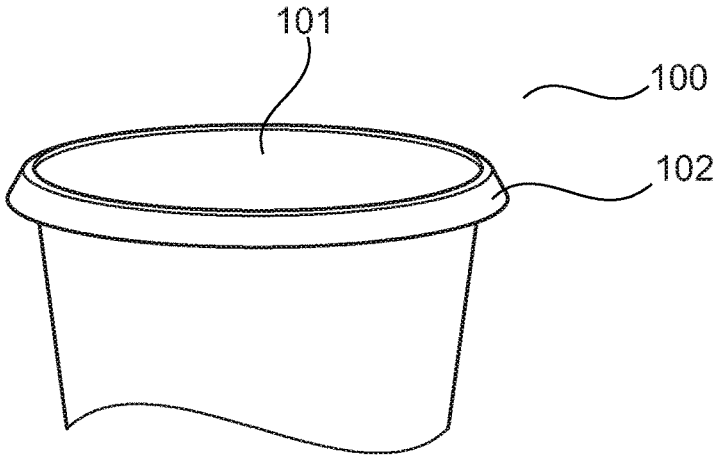
FIG. 1 illustrates the shaft-part of a glove comprising a collar forming a folded down border extending outwards from the glove shaft, and in a perspective view.

FIG. 1 illustrates a glove 100 of a shape according to the invention. For clarity only the shaft-part or upper part of the glove 100 near the opening 101 of the glove is shown and the lower hand-shaped part—optionally with up to 5 fingers—is not shown. This lower hand-shaped part of the glove may be shaped and formed as any conventional glove.

As outlined in FIG. 1, the glove 100 comprises a collar 102 reinforcing the opening 101 of the glove through which the hand is inserted. The collar 102 is of a generally conical shape and positioned around the opening 101 of the glove, extending from the opening 101 with an increasing diameter in a direction towards the first hand-shaped end of the glove. The collar hereby forms a circumferential trough 104 on the glove 100. The trough 104 or channel may act as a fluid collecting deepening or space and prevent fluids from running down the arm of the user when working. The trough is more clearly seen in the cross-sectional view of a glove shown in FIG. 2 or 3.

Figure 2:
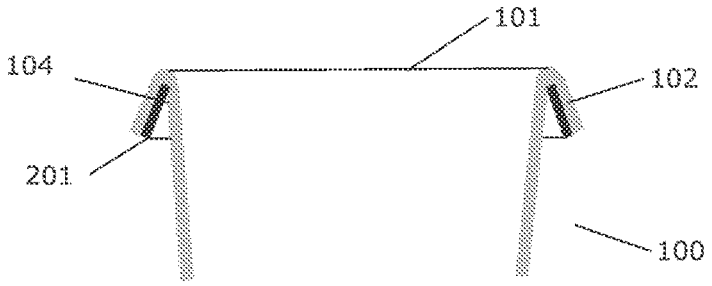
(prior art) Fig. 2
FIGS. 2-4 illustrate different examples of a glove with a reinforcing collar as known in the art.

A glove 100 comprising such advantageous collar 102 may conventionally be manufactured by dip molding by placing a ring 201 of a generally conical shape on the shaft or around the wrist of a hand model on a correspondingly conical surface. The hand model is then dipped and covered with the glove material one or more times. When dried and vulcanized, the glove is pulled off the model, and turned inside out except from the part reinforced by the ring. The border of the glove thereby remains bended down when pulled off the hand model forming a collar 102 and as illustrated in FIG. 2, where the shaft-part of a glove 100 is shown in a cross-sectional view.

Figure 3:
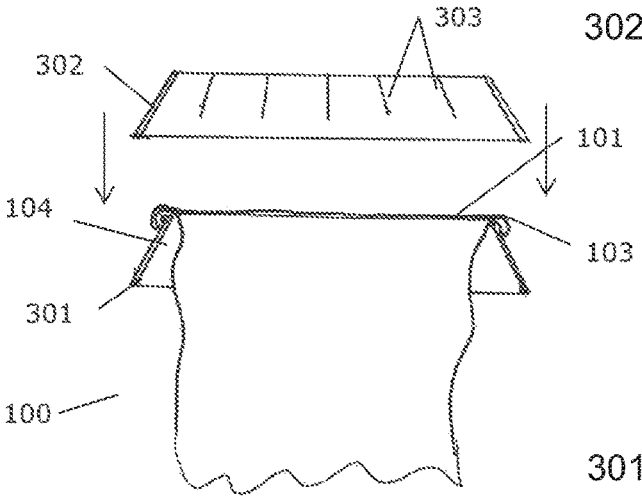
(prior art) Fig. 3
Figure 4:
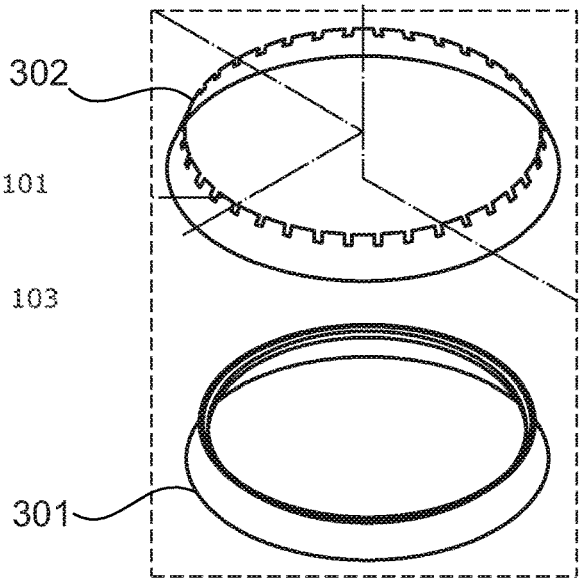
(prior art) Fig. 4

FIG. 3 illustrates a glove 100 as known in the art and with a collar 102 which is here formed by an inner ring 301 and an outer ring 302. Both these rings are approximately conical in shape. The glove may be manufactured by stretching the edge 103 of the glove out over the edge of the inner ring 301 and then pressing or clicking the outer ring 302 onto the inner ring as indicated by the arrows. The outer ring 302 may optionally comprise a number of slits 303 to increase its flexibility and ability to be pressed onto the inner ring and the glove edge. The inner and outer rings are shown in FIG. 4 in a perspective view.

Figure 5A:
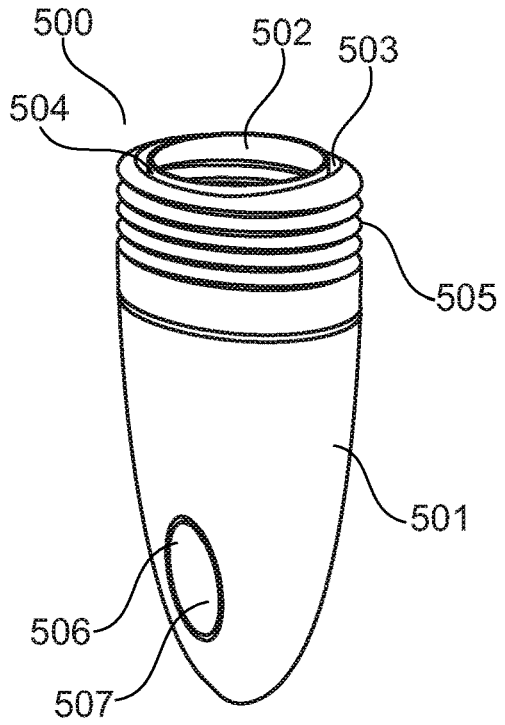
Fig. 5a (prior art)
FIG. 5A illustrates a device for taking gloves on and off with a glove partly inserted as seen in a perspective view.
Figure 5B:
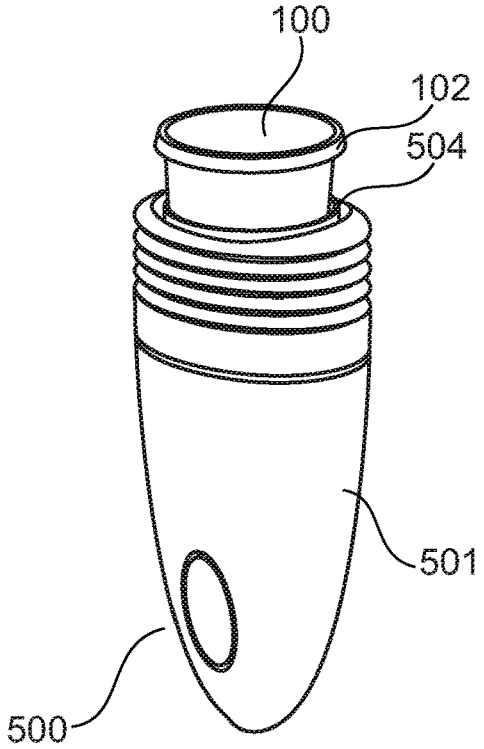
FIG. 5B illustrates the device of FIG. 5A with a glove partly inserted into the container.

FIG. 5 illustrates a device as known in the art, 500, for aiding in taking on and off a glove 100 of an elastic material from a hand of a user according to the invention and as seen in a perspective view. The device 500 comprises a container 501 with an opening 502 through which the glove and the users hand is inserted. The same device is shown in FIG. 5B with a glove 100 halfway inserted into the container. The device in short works by the control of the air pressure inside the container. In the device shown here, the control of the air pressure is established by means of a bellows 505 in combination with a non-return valve 506 and a vent 507. When the users hand is put into or inserted in a glove already hanging in the container, or when a hand wearing a glove is inserted into the container, the bellow part 505 of the container is compressed and the air is pressed out of the container through the non-return valve 506. As the hand is again removed, the bellow is again enlarged and an underpressure created within the container, enlarging the glove and enabling the hand to be removed from the glove. If the glove is to be taken on, a vent 507 in the container is activated and opened preferably simply by the hand from within the container. Hereby the underpressure is removed and the glove stays on the hand when removed and retracted from the container. The change in pressure may in other devices be created for example by means of a pump.

In order to create the desired underpressure within the container 501, the glove 100 preferably needs to seal against the opening 502 of the container. The glove according to the invention comprising a conical collar 102 is particularly advantageous in this respect because of the collar 102 both in providing a seating for the collar against the opening of the container and in preventing the glove in being unintentionally pressed down into the compartment by the user.

Figure 6:
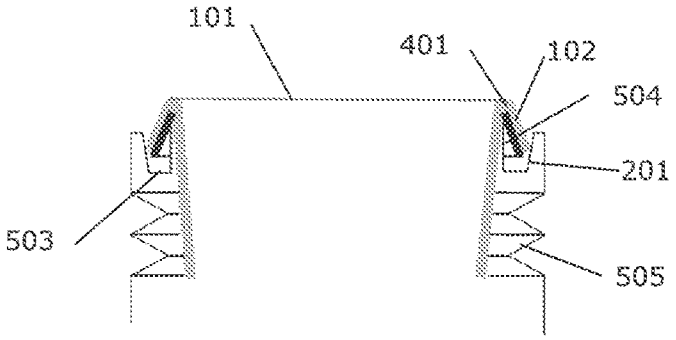
FIGS. 6 and 7 illustrate different embodiments of the engagement of a glove with the opening of the container in a larger detail.
Figure 7:
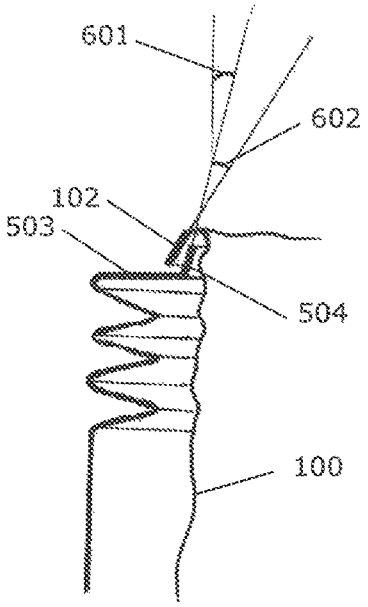

This functioning can be seen in more detail in FIGS. 6 and 7. The container 501 of the device 500 preferably comprises a rim 503 around the circumference of the opening 502 acting to support the collar 101 of the glove, such that the glove when placed in the container rests or lies against the rim 503. Furthermore, the rim here comprises an edge 504 protruding outward from the container (upwards in the figure) such as to engage with the conical collar 102 on the glove 110 as may be seen in more detail in FIG. 7. In the embodiment of FIG. 6, the edge surface 504 is approximately perpendicular to the rim 503 and the longitudinal direction of the container. In FIG. 7, the edge surface 504 is approximately conical narrowing in towards the opening of the container. The edge surface may be angled differently 602 than the collar 101 of the glove 100. The edge surface may be angled around 5-15 degrees to the glove collar. Hereby the glove is guided onto the rim of the container and improves the sealing of the glove to the container. This makes the device more effective for the removal and taking on of gloves. Further the difference in angle ensures that the gloves can be more easily released from the rim of the container again.

The conical collar 102 or folded down border of the glove acts to reinforce the glove opening. The collar furthermore act to maintain the overall shape of the glove opening such that is easier inserted onto the rim 503 of the container opening and such that the collar acts as a seating against the opening of the container effectively sealing the compartment for the underpressure to be effectively created. As mentioned previously, the collar of the glove may also be advantageous in preventing fluid from running from the gloved hands and down the arms when working.

In order to realize these advantages, the collar of the glove needs to have a certain stiffness On the other hand a too rigid collar decreases the comfort of the user and may even be in the way or get caught in corners or the like when the user is working. Further, the collar should advantageously have as small a weight as possible in order to work effectively on gloves with a thinner material thickness.

Figure 8:
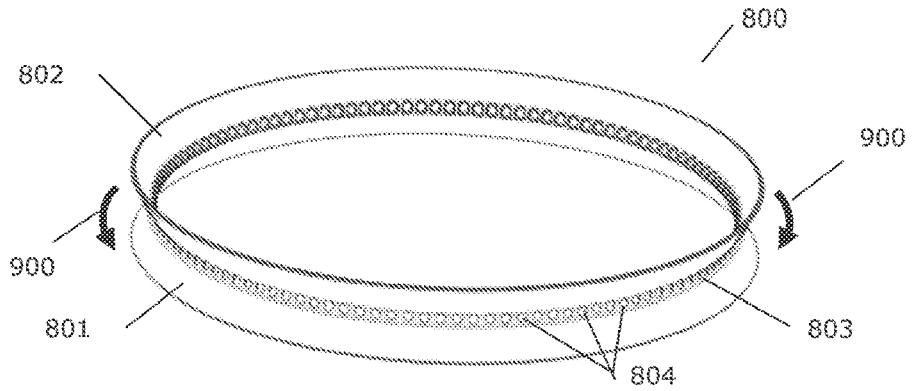
FIG. 8 illustrates an embodiment according to the invention of a ring-shaped member for the forming of a collar on a glove.
Figure 10:
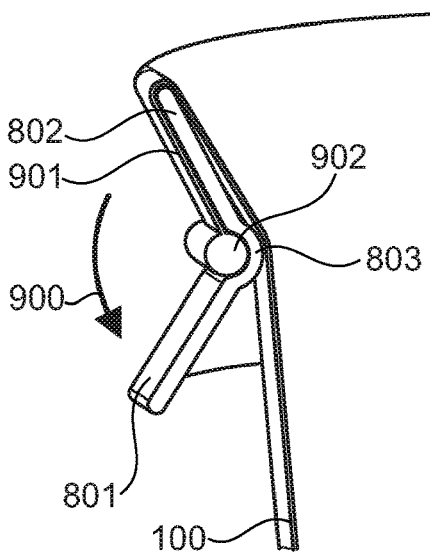

These advantages are all obtained by a glove with a collar comprising a ring-shaped member 800 according to the embodiment shown in FIG. 8. In this embodiment, the ring-shaped member 800 comprises a first annular portion 801 of a conical shape, a second annular portion of a conical shape 802, and a central annular portion 803 in between the first and the second annular portions. The diameter of the ring-shaped member is the smallest at the central portion with each of the first and second annular portions extending outwards and away from the central portion. The ring-shaped member is foldable about the central portion 803 as illustrated by the arrows 900, folding into a folded configuration where the second annular portion 802 is folded down to lie essentially alongside the first annular portion 801. This is illustrated in FIG. 10, where the ring-shaped member is folded to hold onto the rim of the glove. The ring-shaped member in that sense is a bi-stable structure with an open configuration as illustrated in FIG. 8 and a folded configuration as shown in FIG. 10.

Figure 11:
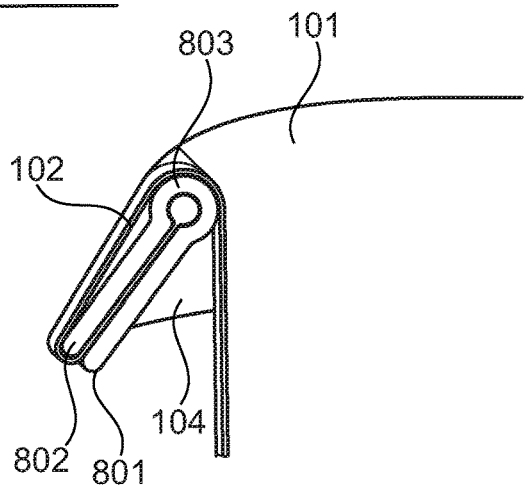
FIG. 11 shows the glove of FIG. 10 with the ring-shaped member in its folded configuration and in a cross-sectional view.

The foldability of the ring-shaped member 800 may be facilitated by for example a curved or semi-circular cross-sectional shape of the central portion 803 as can be seen more clearly in FIG. 10 or 11, optionally in addition to a reduced stiffness of the central portion obtained for example by a smaller wall thickness of the central portion and/or by a number of holes 804 or perforations in the central portions. As the first and second annular portions are both essentially conical, the overall shape of the ring-shaped member in its folded configuration is likewise essentially conical.

In an embodiment, the ring-shaped member 800 is molded in one piece as a single component. The ring-shaped member may be molded by injection molding of a plastic material such as a PPC, PP, PVC, POM, PP-H, or PE.

Figure 9:
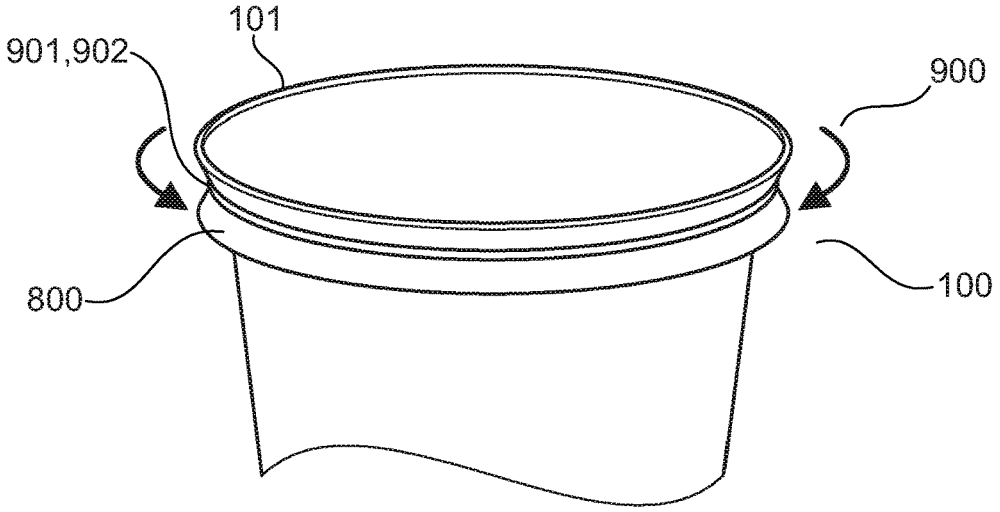
FIGS. 9 and 10 illustrate an embodiment of a glove with the ring-shaped member attached in a perspective and cross-sectional view, respectively.

FIG. 9 shows a ring-shaped member 800 as attached to the opening 101 of a glove, which is also shown in FIG. 10 in a larger detail and a cross-sectional view. Here, the rim 901 of a conventional glove of an elastic material is stretched out over the second annular portion 802. In an embodiment the rim comprises a rolled edge 902 and the central annular portion 803 comprises a curved shape corresponding to the rolled rim edge such as to receive the rolled rim edge 902. The second annular portion 802 of the ring-shaped member 800 is then folded down as indicated by the arrows 900 to lie adjacent or flush to the first annular portion 801 as shown in FIG. 11. In the folded configuration in this embodiment, a portion of the elastic material of the glove lies in between the first 801 and the second 802 annular portions.

By the stretching of the elastic material over at least a part of the ring-shaped member 800, the ring-shaped member is attached to the opening 101 of the glove to form a circumferential trough 104 around the opening of the glove.

Figure 17:
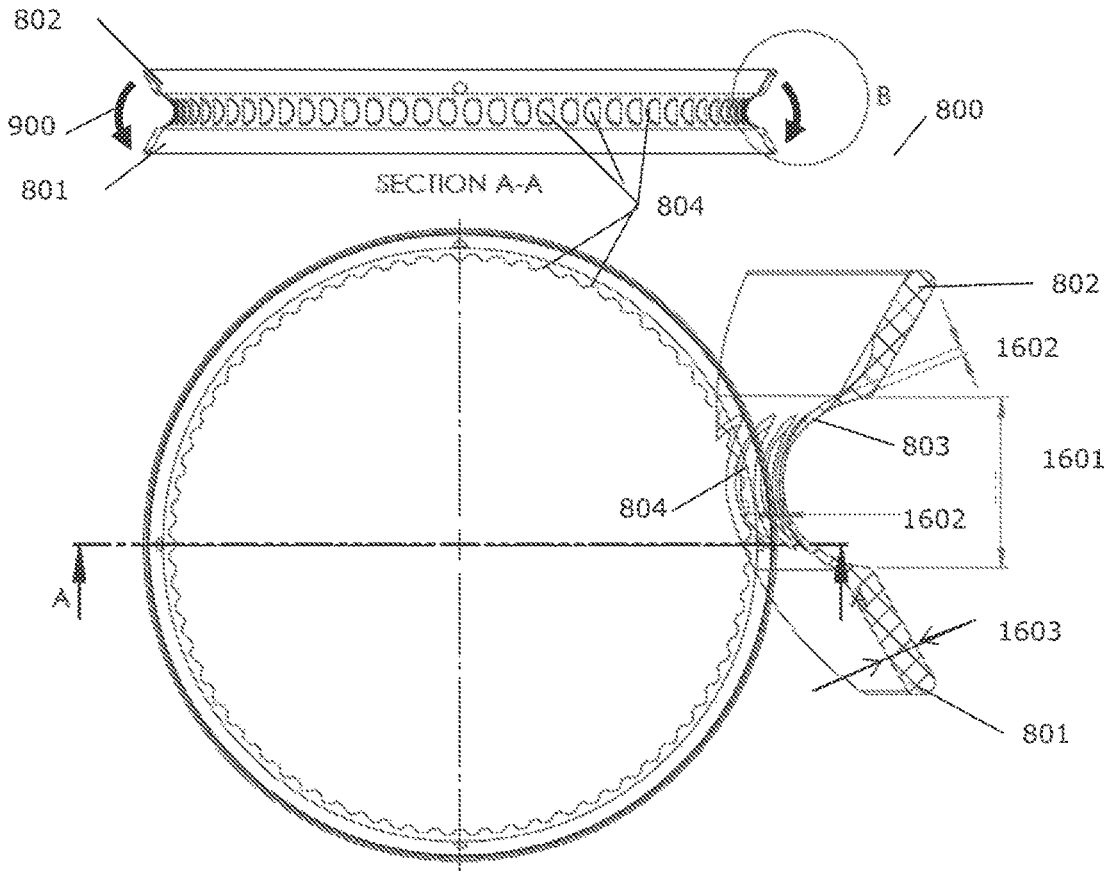
FIGS. 17-18 show two embodiments of a ring-shaped member.
Figure 18:
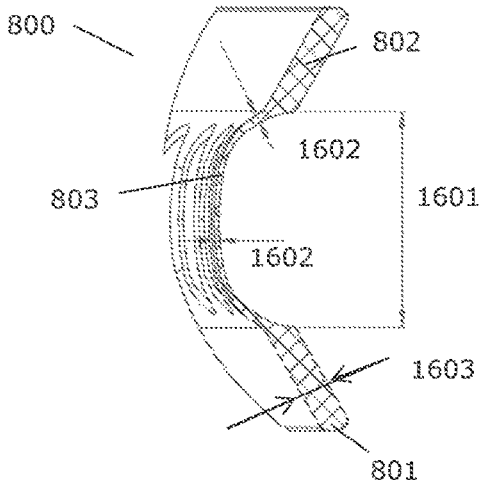

Two embodiments of a ring-shaped member 800 are shown in greater details in FIGS. 17 and 18. In FIG. 17, the ring-shaped member is shown in a side view, a top view, and in a cross-sectional view, respectively. In FIG. 18 is shown a further embodiment of a ring-shaped member in a cross-sectional view. The most notable difference between the two embodiments is the different size and curvature of the central annular portion 803 which attains a greater height 1601 and a larger radius in the embodiment of FIG. 18. The ring-shaped members 800 of FIGS. 17 and 18 are hereby dimensioned to be used on a glove of a relatively thinner and thicker glove material and/or to a glove with a relatively small or large rolled edge 902 of the glove, respectively and most notably by the dimensioning of the central annular portion 803. The height 1601 of the central annular portion is in the range of 5-7 mm and of approximately 6 mm for the embodiment of FIG. 17 suitable to be fitted to conventional gloves of a relatively thin glove material. The height 1601 of the central annular portion is in the range of 8-10 mm and of approximately 9 mm for the embodiment of FIG. 18 suitable to be fitted to conventional gloves of a relatively thicker glove material. Any heights, such as in the range of 3-15 mm, may be adequate for gloves of different thickness and/or with rolled edges 903 of different sizes.

The wall thickness 1602 of the central annular portion 803 may be thinner near the center and may thicken out towards the first and second annular portions 801, 802. The wall thickness 1602 may be in the range of 0.05-0.50 mm, such as in the range of 0.12-0.37 mm. The wall thickness 1603 of the first and second annular portions 801, 802, may be in the range of 0.7-2.0 mm such as in the range of 0.9-1.2 mm (as on the embodiments of FIGS. 17 and 18). The first and second annular portions 801, 802 may have the same wall thickness or may be of different wall thickness, preferably with the second annular portion 802 having a larger wall thickness than the first annular portion 801.

Figure 12:
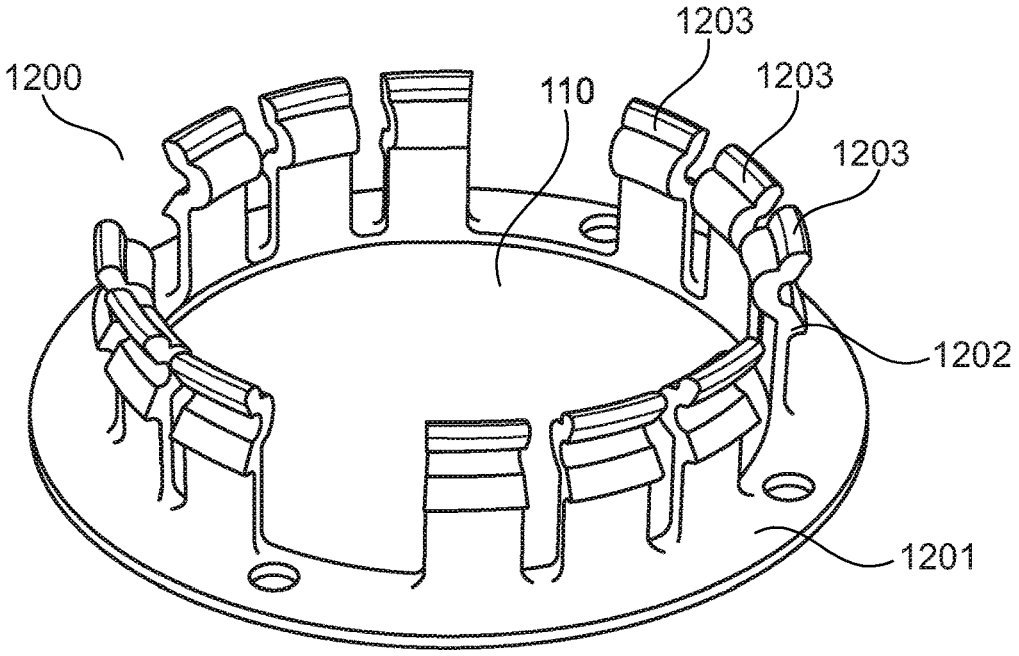
FIGS. 12 and 13 show a fixture for the attachment of a ring-shaped member without and with the ring-shaped member in position.
Figure 13:
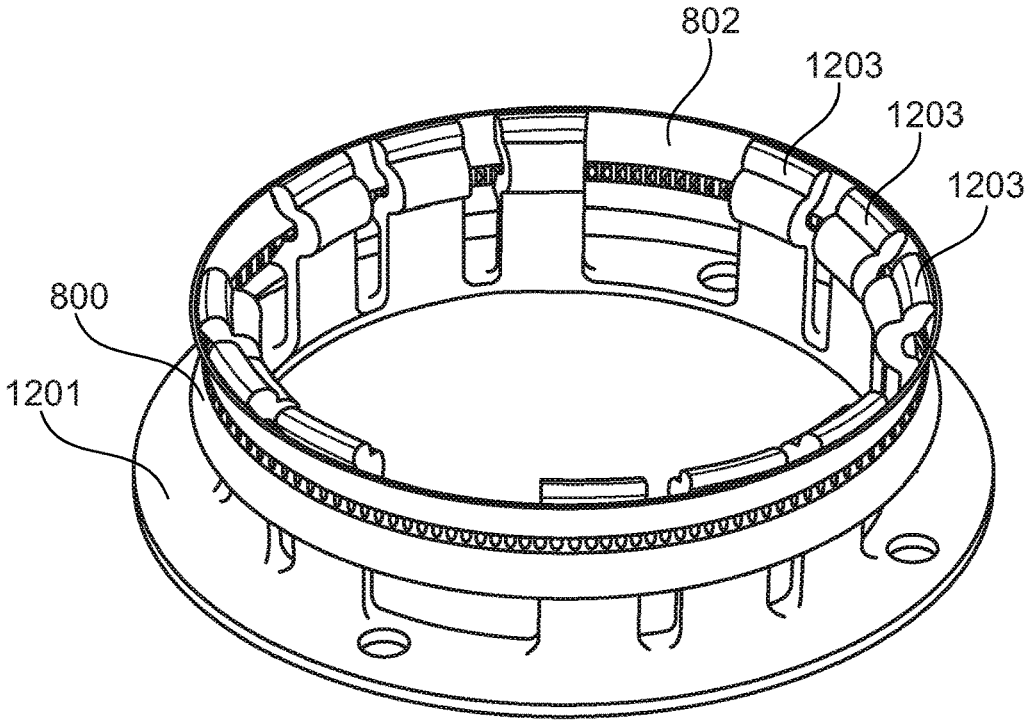

FIG. 12 shows an embodiment of a fixture 1200 which can be used in mounting a ring-shaped member 800 on a glove 100 to form a circumferential trough 104 on the glove. The fixture 1200 comprises a base portion 1201 which can advantageously be attached to a table or the like. The fixture further comprises a cylindrical portion 1202 extending from the base. During assembly, a ring-shaped member 800 is positioned on the cylindrical portion 1202 of the fixture as illustrated in FIG. 13. Then the edge or rim of the glove of the elastic material is stretched out over the second annular portion of the ring-shaped member and the ring-shaped member is folded and the assembled glove with a collar is drawn off the fixture. In an embodiment, the flexibility of the cylindrical portion 1202 of the fixture is increased by the cylindrical portion being split into a number of protruding members 1203 making it easier to position the ring-shaped member on the fixture and remove the glove when assembled.

Figure 14:
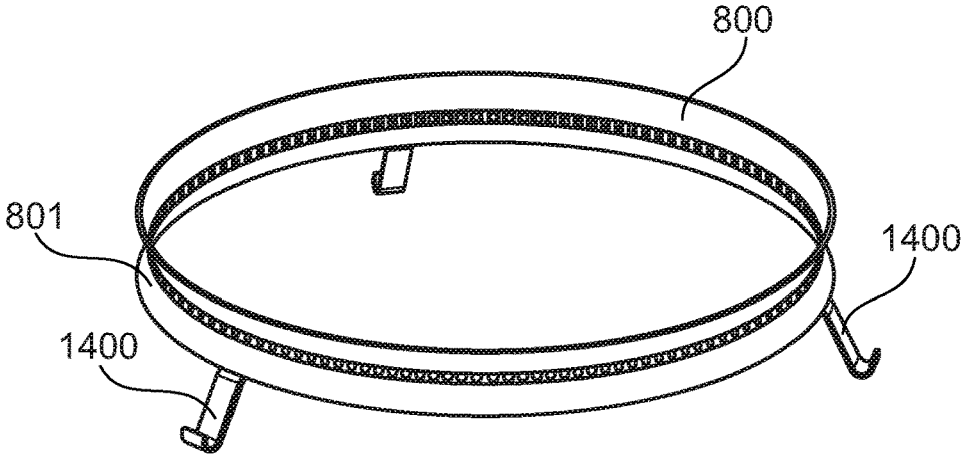
FIG. 14 shows a further embodiment of a ring-shaped member according to the invention comprising a number of clips.
Figure 15:
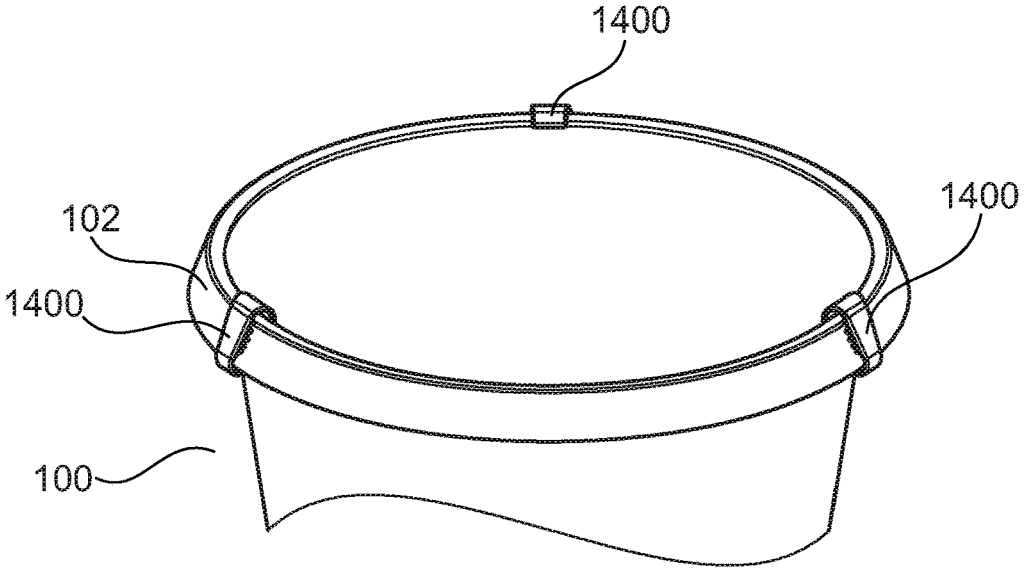
FIG. 15 illustrates a glove comprising a ring-shaped member secured in its folded configuration by means of a number of clips.
Figure 16:
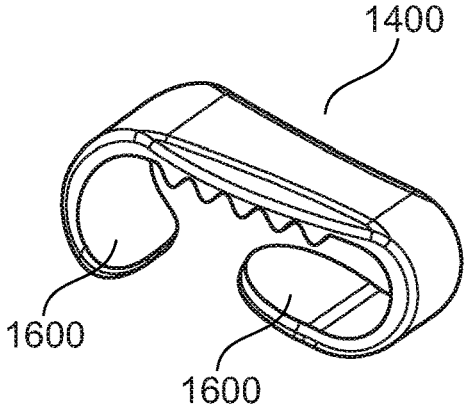
FIG. 16 shows a clip.

FIG. 14 shows an embodiment of a ring-shaped member 800 comprising a number of clips 1400 which are compliantly attached to the first annular portion 801. When the ring-shaped member 800 has been attached to the glove and folded, the clips 1400 can be bent up and clipped around the upper edge of the collar 102 of the glove as shown in FIG. 15. The clips in this way act to further secure the folded configuration of the ring-shaped member. He collar of the glove in this way can be prevented from opening up even when worn or if otherwise unintentionally deformed. Alternatively or additionally, the clips 1400 may be formed as separate members as illustrated in FIG. 15 and clipped around the edges of the collar of the glove to ensure the folded configuration of the ring-shaped member.

Additionally or alternatively, an adhesive may be used to secure the ring-shaped member in its folded configuration.

While preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

The invention claimed is:

1. A ring-shaped member for engaging with an opening of a glove to form a circumferential trough around the opening of the glove, wherein the ring-shaped member comprises a first annular portion of a conical shape, a second annular portion of a conical shape, and a central annular portion in between the first and the second annular portions, and wherein a diameter of the ring-shaped member is the smallest at the central portion, and wherein the ring-shaped member is foldable about the central portion to attain a folded configuration wherein the second annular portion is folded down to lie essentially alongside the first annular portion;

wherein the central portion comprises a number of holes.

2. The ring-shaped member according to claim 1 wherein a wall thickness of the central portion is smaller than a wall thickness of the first and/or second annular portion.

3. The ring-shaped member according to claim 1 wherein the ring-shaped member further comprises a number of clips compliantly attached to an edge of the first annular portion.

4. The ring-shaped member according to claim 1 wherein the ring-shaped member is molded as a single component.

5. The ring-shaped member according to claim 1 wherein the ring-shaped member is of a plastic material of the group of PPC, PP, PVC, POM, PP-H, or PE.

6. The glove comprising at a first end a hand-shaped portion and at the opposite second end a shaft portion with an opening for the insertion of a hand of a user, wherein the glove comprises a collar of a generally conical shape and positioned around the opening of the glove, the collar extending from the opening with an increasing diameter in a direction towards the first end of the glove, wherein the collar of the glove comprises a ring-shaped member according to claim 1 and wherein the ring-shaped member is folded into its folded configuration when positioned on the glove.

7. The glove according to claim 6 wherein at least the shaft portion of the glove is made of an elastic material and wherein the ring-shaped member is attached to the glove by a portion of the elastic material being stretched over at least the second annular portion of the ring-shaped member.

8. The glove according to claim 7 wherein a portion of the elastic material lies in between the first and the second annular portions when folded.

9. The glove according to claim 6 where the glove further comprising a number of clips clipped around at least a part of the ring-shaped member for securing the folded configuration of the ring-shaped member.

10. A method of manufacturing a glove according to claim 6, the method comprising the steps of providing a glove of an elastic material, providing a ring-shaped member, folding a portion of the glove near the opening over the second annular portion, and folding the ring-shaped member into its folded configuration to thereby form the circumferential trough on the glove;

wherein the ring-shaped member comprises a first annular portion of a conical shape, a second annular portion of a conical shape, and a central annular portion in between the first and the second annular portions, and wherein a diameter of the ring-shaped member is the smallest at the central portion, and wherein the ring-shaped member is foldable about the central portion to attain a folded configuration wherein the second annular portion is folded down to lie essentially alongside the first annular portion.

11. The method according to claim 10, wherein the folded portion of the glove is folded by stretching the elastic material of the glove over the second annular portion.

12. The method according to claim 10 further comprising guiding the glove through the central opening of the ring-shaped member.

13. The method according to claim 10 further comprising clipping one or more clips around at least a part of the ring-shaped member for securing the folded configuration of the ring-shaped member.

14. The method according to claim 10 further comprising securing the folded configuration of the ring-shaped member by the addition of an adhesive.

15. The method according to claim 10 further comprising the steps of providing a fixture and positioning the ring shaped member on the fixture prior to the step of folding the portion of the glove about the second annular portion.

* * * * *